United States Patent [19]

Gonzalez

[11] Patent Number: 4,782,601

[45] Date of Patent: Nov. 8, 1988

[54] FOOT DRYING ASSEMBLY

[76] Inventor: Alejandro R. Gonzalez, 13941 SW. 92nd Ave., Miami, Fla. 33176

[21] Appl. No.: 805,675

[22] Filed: Dec. 6, 1985

[51] Int. Cl.[4] ..... F26B 9/00

[52] U.S. Cl. ..... 34/233; 34/237; 34/243 R; 128/400; 219/217; 219/368; 219/370

[58] Field of Search ..... 34/237, 243, 233, 90, 34/91, 202; 128/375, 400, 402; 219/217, 370, 368, 369, 367

[56] References Cited

U.S. PATENT DOCUMENTS

| | | | |
|---|---|---|---|
| 408,235 | 8/1889 | Haskell | 34/155 |
| 2,779,856 | 1/1957 | Fahner | 219/368 |
| 3,358,382 | 12/1967 | Glintz | 34/202 |
| 3,378,009 | 4/1968 | Peplin | 34/202 |

*Primary Examiner*—Larry I. Schwartz

[57] ABSTRACT

A foot drying assembly of the type designed to be positioned on a supporting surface such as the ground or floor and including a support platform having an apertured grid structure dimensioned and configured for placement of both feet simultaneously thereon. A blower assembly directs a forced flow of air into interruptive relation with a heater structure and there beyond into an air chamber which includes a plurality of air guides specifically structured to proportion the quantity of air delivered to the various portions of the air chamber such that heated air will rise from the air chamber and pass through the overlying grid structure to engage and envelope the bottom and sides of the feet placed thereon. An additional air vent is disposed in the path of fluid flow so as to pass heated air over the toes, front and top portion of the feet for drying thereof.

16 Claims, 2 Drawing Sheets

FOOT DRYING ASSEMBLY

BACKGROUND OF THE INVENTION

1. Field of the Invention

This invention relates to a foot drying assembly including a support platform for the placement of booth feet simultaneously thereon wherein the assembly directs heated air over various portions of the foot for complete, efficient and thorough drying.

2. Description of the Prior Art

Under normal sanitary living conditions, people bathe frequently over a week's time and even daily. In the normal course of such bathing, it is common practice to dry off with a towel of generally sufficient size to absorb a majority of the collected moisture on the bather's body. In toweling dry, the user of the towel almost always starts drying from the head of his body downwardly and the towel is applied to the feet last. When such occurs, two things happen, most of the towel is significantly damp from absorbing the majority of moisture over the remainder of the user's body. In addition, the foot and toes of the user are commonly hard to reach and dried last. Accordingly, the feet frequently receive only a general drying application rather than a detailed "examination" with a drying towel for the purpose of removing all of the moisture possible.

As a result, portions of the foot, including between the toes and surrounding crevices frequently remain damp until dried inadvertently by contact with clothing or normal evaporation of this dampness to the surrounding atmosphere.

Therefore, the crevices between the toes and various areas of the feet remain moist for a significant period of time after the bathing has been concluded. These moistened areas, especially between the toes and the like then in fact become breeding grounds for fungus and the like which results in irritation to the feet and such commonly known maladies as "athlete's foot".

In order to avoid the above unpleasantries, it is necessary to completely dry the foot in an efficient manner without causing undue, excessive rubbing of certain relatively tender areas as between the toes where most moisture collects. Accordingly, there is a need in the area for a drying assembly especially designed to dry the bare feet from excess moisture in an efficient fashion without requiring unnecessary and time-consuming rubbing or patting of the hard to get to areas mentioned above. Such a preferred drying assembly should be capable of concurrently drying both feet without the need for undue bending or stooping but by mere placing both feet on a supporting and drying platform after activation of the subject assembly.

The prior art includes various warming and heating assemblies including the structure disclosed in the U.S. Pat. No. 4,258,248 to Campo, which relates to an instant hot air welcome mat. This structure is designed for placement and use outside of the house as a lead-in to an access opening such as the front door. In operation, heated air flows over the shoes and/or feet of the person entering the house merely by placing his weight thereon.

Other structures in the prior art are disclosed in the U.S. Pat. No. 3,007,256 to Ruoy, and Wriggleworth et al, U.S. Pat. No. 3,089,942.

SUMMARY OF THE INVENTION

This invention relates to a foot drying assembly of the type designed to be placed on a floor or like supporting surface and which is of a size and configuration for concurrent placement of both feet over an apertured grid structure through which heated air is forced to pass in substantially surrounding or enveloping relation with the bottom and side portions of the foot and toes. In addition, air vents are located in what may be considered a front portion of the housing of the subject drying assembly wherein heated air is forced from such air vent and directed, due to the disposition of the air vent over the front portion of the foot including the toes and crevices therebetween.

In size and shape, the subject foot drying assembly at least partially resembles a conventional bathroom type scale on which a person stands. However, with regard to the present invention it should be noted that the housing and grid structure of the subject drying assembly may be structured so as to support the weight of an adult person while both feet are placed in a standing position on the grid structure or alternately the grid structure may be primarily designed for use to absorb the partial weight of a person such as when the person is sitting on a chair, stool or the like and places his feet concurrently on the grid structure for drying thereof.

More specifically, components of the subject drying assembly include one or more blowers disposed adjacent to an air intake in a leading portion of the housing. The blowers are structured to direct air back through a hollow interior portion of the housing generally and more specifically into an air chamber which underlys the apertured grid structure on which the feet are placed. A heating facility such as one or more resistance heaters are placed in interruptive relation to the path of travel of the forced flow of air generated by the blower assembly such that the air is heated to a comfortable yet effective drying temperature prior to passing into the air chamber and being distributed upwardly through the apertured grid structure onto the feet.

In addition, guide means are provided for directing the forced flow of heated air throughout the air chamber in a manner which will provide a substantially even distribution of air along the apertured surface of the grid structure. Due to this distribution effect of the forced flow of air, practically all portions of the apertured grid structure have heated air issuing therefrom.

Another embodiment of the present invention comprises the housing as set forth above including a hollow interior defining in part an air chamber disposed in underlying relation to and communication with an apertured grid structure serving as a platform on which both feet of the user are placed. However, in this embodiment, the air driving means or blower assembly as well as the heating means are self-contained into a single unit which is removably attached to the housing so as to direct heated air throughout in the manner set forth above. The combined air directing means and heating means may be in a conventionally recognized package such as a blow dryer commonly used for the drying of hair as well as other specially designed and configured packages adapted for use in combination with the housing on which the feet are placed.

Regardless of the embodiment utilized, each such structure includes a control means for activating both the air directing means or blower assembly as well as the heating means. In addition, such control means may have a regulating feature controlling the speed of the blower assembly as well as the generated temperature by the heating means.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a full understanding of the nature of the present invention, reference should be had to the following detailed description taken in connection with the accompanying drawings and which.

Like reference numerals refer to like parts throughout the several views of the drawings.

DETAILED DESCRIPTION OF THE PREFERRED EMBODIMENT

As shown in FIGS. 1-6, the present invention is directed towards a heating assembly generally indicated as 10 and including a housing 12 having a leading portion 14 and a support platform generally indicated as 16. The housing 12 has a substantially low, flat profile wherein the longitudinal dimension is substantially greater than the height. Primarily, the housing 12 is designed to rest or be positioned on a floor or like supporting surface so as to be readily available for placing both feet thereon either in a standing or sitting position.

Figure 5:
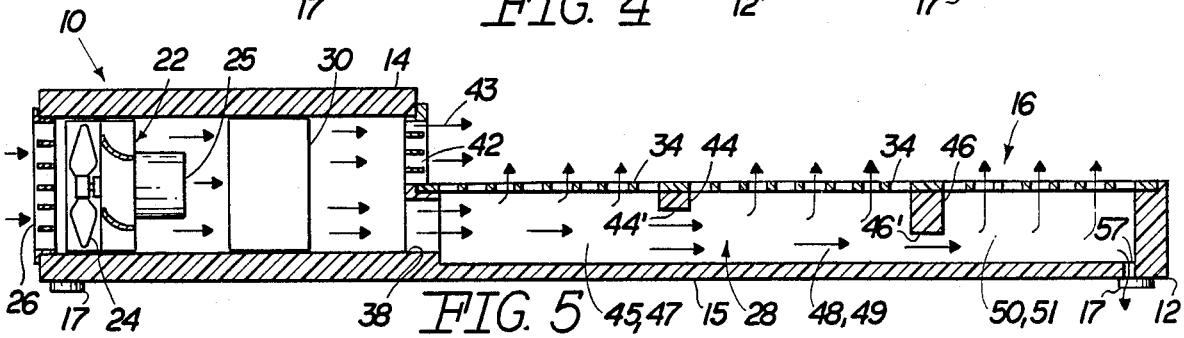
FIG. 5 is a sectional view along line 5—5 of FIG. 1.
Figure 6:
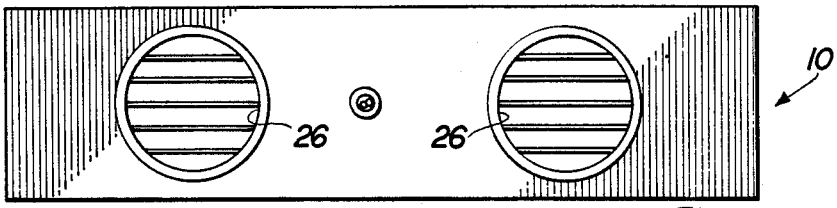
FIG. 6 is an end view opposite to FIG. 4 of the embodiment of FIG. 1.

The housing 12 includes a base 15 having supporting tabs or like structure 17 extending outward from the undersurface thereof for support on a surface such as a floor (See FIG. 5).

Figure 1:
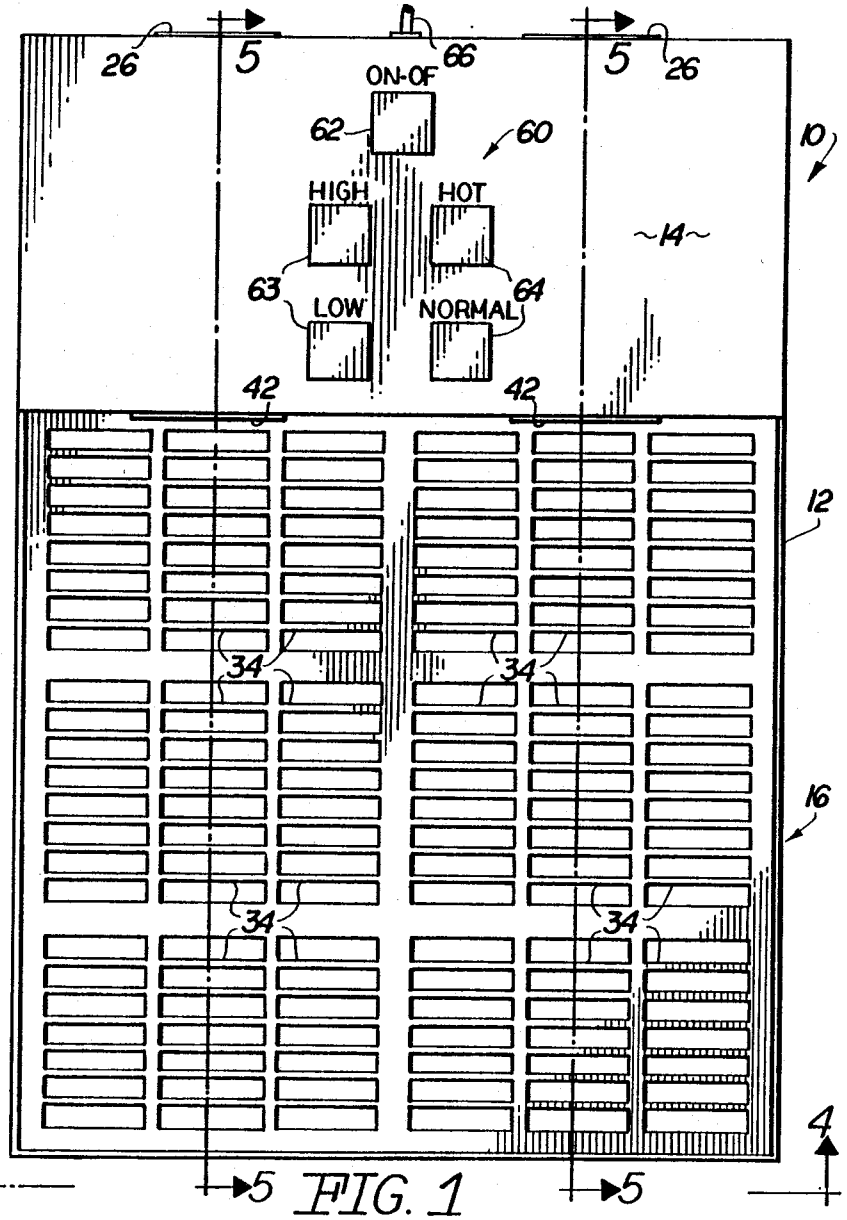
FIG. 1 is a top plan view of the feet drying assembly of the present invention.
Figure 2:
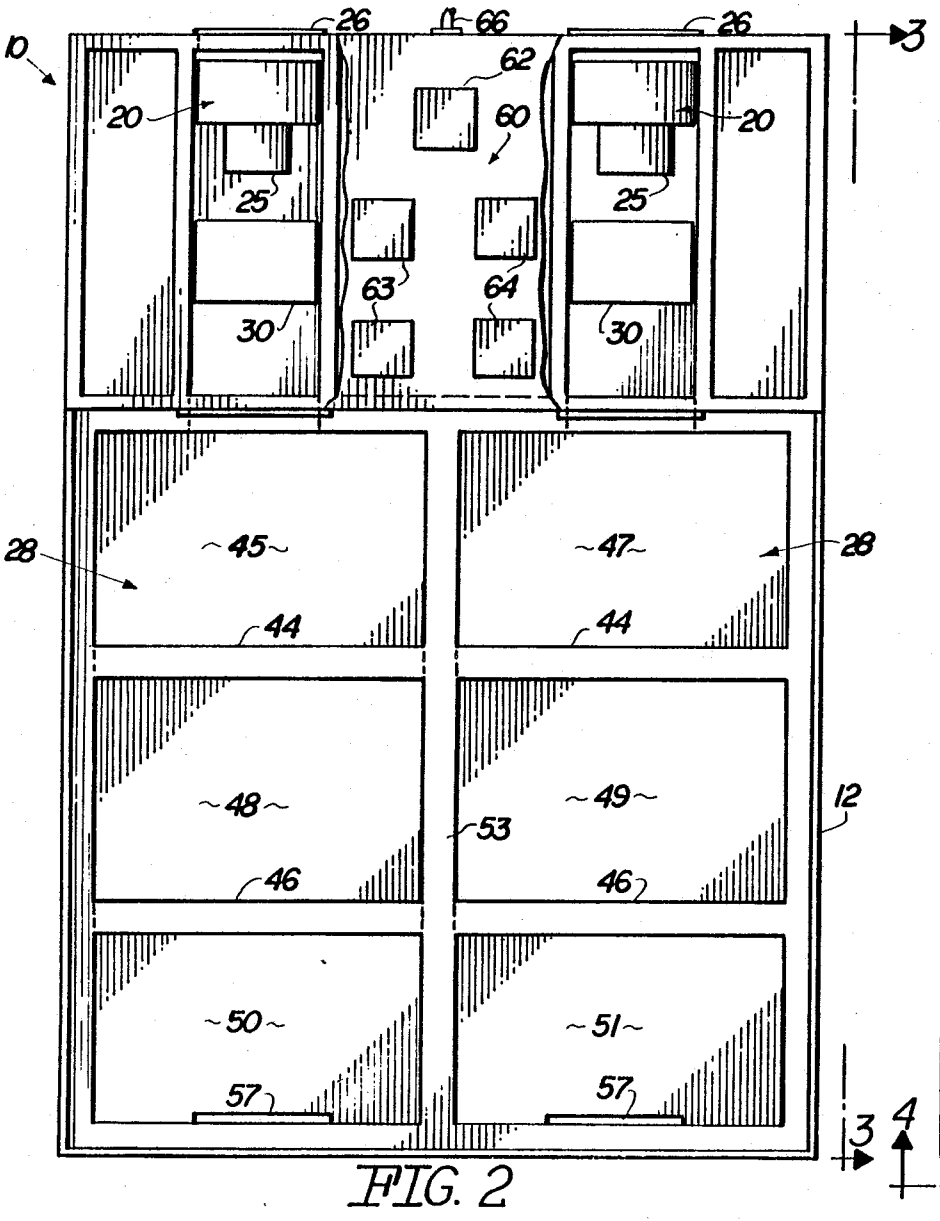
FIG. 2 is a top plan view of the interior of the feet drying assembly.
Figure 3:
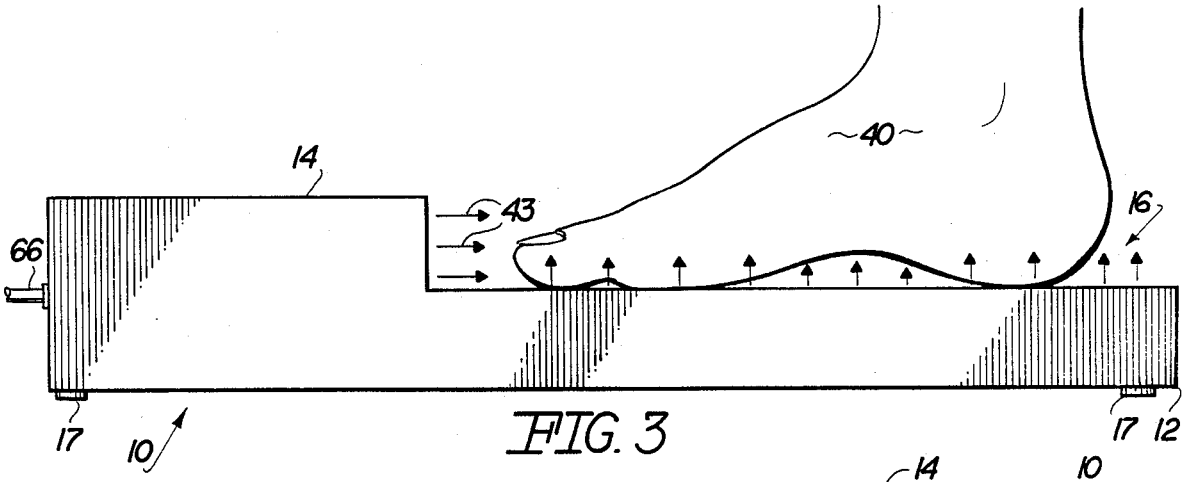
FIG. 3 is a side plan view along line 3—3 of FIG. 1.
Figure 4:
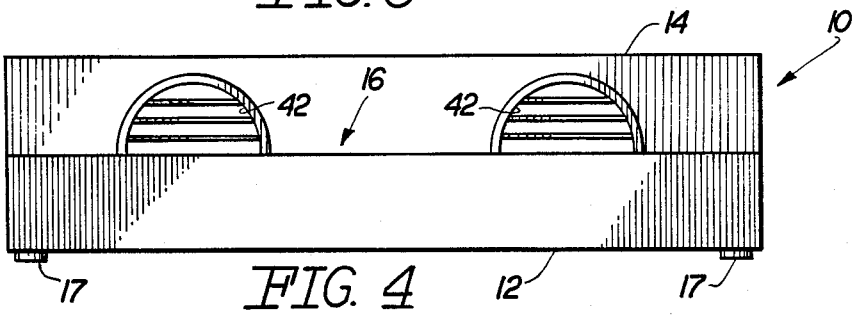
FIG. 4 is an end view along line 4—4 of FIG. 1.

With reference to FIGS. 2 and 5, the housing 12 includes a hollow interior portion in which an air directing means 20 is defined by one or more blower assembly 22 comprising a blower fan 24 and electric motor for driving such fan 25. When the drying assembly 10 includes a plurality of blower assemblies 22, each is located near an air intake 26 in which air flows upon activation of the respective blower assemblies. Accordingly, it is readily apparent that the blower assemblies 22 create a forced flow of air through at least part of a hollow interior portion of the housing 12 defined by air chamber generally indicated as 28.

However, prior to reaching air chamber 28, the forced flow of air is heated to a preferred temperature by heating means 30 which, may be in the form of a conventional resistance-type heater not shown in detail for purposes of clarity. It should be noted that the heating means 30 may be associated with each of the blowers 22 so as to direct air thereby, and at least partially into the air chamber 28. The air chamber 28 is of course located in underlying and communicating relation with an apertured grid structure 34 which defines part of the support platform 16 on which the feet (see FIG. 3) 40 are located. As clearly shown in FIG. 5, entrance 38 to air chamber is located immediately below but adjacent to air vent means 42 disposed in a generally higher position than the grid structure 34. The placement of the air vent 42 is such as to receive forced and heated flow of air from the blower assemblies 22 and heating means 30 so as to direct the heated air onto the toes and generally upper portion of the feet 40 of the user. The flow of the heated air from air vent 42 is indicated by directional arrows 43 in FIGS. 3 and 5 for purposes of clarity.

As shown in FIG. 5, the remaining amount of the forced flow of air is directed through passage 38 leading to air chamber 28. Guide means in the form of plurality of deflector structures 44 and 46 are disposed within air chamber 28 in substantially transverse relation to the direction of air flow therethrough. More specifically the placement of these deflector structures 44 and 46 serves to at least partially segregate the air chamber 28 into a plurality of successively disposed chamber segments, 45, 47 and 48, 49 and 50, 51 (see FIGS. 5 and 7). With regard to FIG. 2 it is readily apparent that the chambers are divided longitudinally but a segregating wall 53. Successively disposed chamber segments 45, 48 and 50; and 47, 49 and 51 are respectively disposed in linear arrays arranged in parallel relation to one another. Each array is in fluid receiving communication with a respective air directing means 20.

With reference to both FIGS. 2 and 5, a substantially even distribution of air is insured to the extent that heated air will rise from the respective chamber segments up through correspondingly positioned portions of the grid structure 34 due to the difference in size of the deflector structures 44 and 46 and the underlying passage 44' and 46' as indicated. It is readily apparent that the respective passages 44' and 46' are located beneath and immediately adjacent to the respective deflector structures 44 and 46. Accordingly, a lesser resistance is presented due to the lesser dimension of deflector structure 44 and the enlarged passage 44' than with the next succeeding deflector 46 and passage 46'. Further, based on the transverse disposition of the deflector structures 44' and 46' a certain amount of air flow will be directed back into the leading chamber segment of the two adjacent chamber segments and forced out through the correspondingly positioned grid structure 34 as shown in FIG. 5.

Additional structural features of the present invention include the provision of a water vent 57 located in base 15 preferably at the end thereof. This water vent is both provided to remove any excess moisture from the air chamber 28 since such water may be accumulated by passing down through the apertured grid structure 34 after dripping from the wet feet of the user.

Additional structural features of the present invention comprise the inclusion of a control means 60, on/-off button 62, blower regulating button 63 and heat regulating button 64, all of which are interconnected to the respective blower assemblies and heating means through substantially conventional circuitry (not shown for purposes of clarity). A source of power is provided through conventional electrical conductor 66 as shown.

Figure 7:
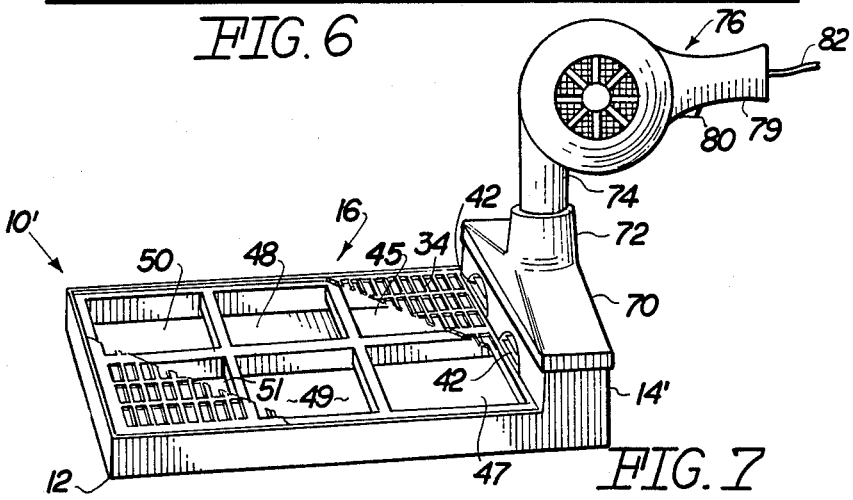
FIG. 7 is an isometric view of another embodiment of the present invention.

With regard to FIG. 7, another embodiment of the present invention comprises the heating assembly 10' of the present invention including a housing 12 similar to the housing shown with regard to the embodiments of FIG. 1-6. Such similarities include the support platform 16, grid structure 34 and plurality of linearly aligned successively disposed chamber segments 45, 48, 50 and 47, 49 and 51. However, the leading portion 14' of housing 12 differs in that it is substantially hollow and disposed to direct a forced flow of heated air into the plurality of chamber segments as well as out through the air vents 42 in the facing surface of the housing 12 similar to that shown with the embodiment of FIGS. 3, 4 and 5. However, the difference being that a hood structure 70 is provided in overlying and directly communicating relation to the interior of the leading portion 14' of housing 12 which further includes a receiving port or channel 72 designed to receive therein a barrel 74 of a portable combined air directing means and heating means (not shown) 78 which may be in the form of a conventional hair dryer as shown. A supporting handle 79 and operating switch 80 serves to activate the combined heating means and air directing means and the assembly 76 is powered by a conventional electrical power source connected by a conductor 82. It should be noted that while the portable self-contained air directing means and heating means are shown in the form of a hair dryer other structures could be specifically designed for direct adaptation for a removable connection to a hood 70 and supporting port 72. Heated air would thereby be provided to the interior of the housing and out through the grid structure 54 and air vents 42 as explained above.

It is therefore to be understood that the following claims are intended to cover all of the generic and specific features of the invention herein described, and all statements of the scope of the invention which as a matter of language might be said to fall therebetween.

Now that the invention has been described,

What is claimed is:

1. A drying assembly primarily designed to dry a person's feet, said assembly comprising:

(a) a housing including a hollow interior portion structured to include an air chamber, (b) a support platform mounted on said housing and including an apertured construction, said support platform disposed in overlying relation to at least a portion of said air chamber, (c) said support platform dimensioned for placement of a person's foot thereon and said apertured construction disposed to establish fluid communication between said air chamber and the feet on said support platform, (d) air driving means mounted on said housing for directing air from an exterior of said housing and into said air chamber and structured to establish a continuous forced flow of air along at least a portion of said hollow interior portion, (e) air guide means mounted on said housing and disposed to define a path of fluid flow within said air chamber and out through said support platform, (f) said air chamber comprising a plurality of chamber segments disposed within said hollow interior portion, each of said chamber segments separated from a next adjacent chamber segment by said air guide means, said plurality of chamber segments collectively disposed successively along a length of said housing, (g) said air guide means disposed within said air chamber in at least partially interruptive relation to said forced flow of air therethrough, said air guide means dimensioned to direct a different quantity of air to various portions of said air chamber, (h) heating means mounted on said housing and disposed in heat transferring relation to said flow of forced air for heating the air, and (i) control means mounted on said housing and accessably disposed on an exterior thereof, said control means connected to said air driving means and said heating means for regulation thereof.

2. An assembly as in claim 1 wherein said guide means comprises a deflector structure and a passage disposed between each adjacently positioned chamber segment of said plurality of chamber segments.

3. An assembly as in claim 2 wherein each of said deflector structures is dimensioned and disposed to deflect air back into a correspondingly positioned one of said adjacent positioned chamber segments and outwardly therefrom through a correspondingly positioned portion of said support platform.

4. An assembly as in claim 3 wherein each of said passages in disposed and dimensioned to direct air from a leading one of said adjacently positioned air chambers to a following one thereof.

5. An assembly as in claim 4 wherein each of said passages in disposed adjacent to and beneath a correspondingly positioned deflector structure and said deflector structure disposed between said respective passage and said support platform.

6. An assembly as in claim 4 comprising a first of said passages being larger than a second and a next succeeding passage wherein successively lesser amounts of air pass into successive chamber segments and up through correspondingly disposed portions of said support platform.

7. An assembly as in claim 1 wherein said support platform comprises an apertured grid structure disposed in overlying relation to said air chamber, said air chamber comprising a plurality of chamber segments extending along the length of said housing successively from a leading portion of said housing to an end portion thereof, said plurality of chamber segments disposed in two elongated arrays extending along the length of said housing in substantially parallel relation to one another and each array dimensioned and disposed in underlying relation to a placement of a foot positioned on said grid structure.

8. An assembly as in claim 7 wherein said apertured grid structure is disposed in air receiving relation to said plurality of chamber segments whereby air is directed from said chamber segments up through said grid structure.

9. An assembly as in claim 7 wherein said guide means comprises a deflector structure and a passage disposed, in each array, between each adjacently positioned chamber segment of said plurality of chamber segments of a given array.

10. An assembly as in claim 9 wherein each of said deflector structures is dimensioned and disposed to deflect air back into a correspondingly positioned one of said adjacently positioned chamber segments of each array and outwardly therefrom through a correspondingly positioned portion of said grid.

11. An assembly as in claim 10 wherein each of said passages is disposed and dimensioned to direct air from a leading one of said adjacently positioned chamber segments of each array to a following chamber segment of said array.

12. An assembly as in claim 11 comprising a first of said passages being larger than a second and next successive passage wherein successively lesser amounts of air pass into successive chamber segments and up through correspondingly disposed portions of said grid structure.

13. An assembly as in claim 7 wherein said support platform comprises an apertured grid structure disposed in air receiving relation to said air chamber so as to receive air passing therethrough upwardly from said air chamber, said grid structure further disposed in a lower, recessed orientation relative to a leading portion of said housing; air vent means for directing air outwardly from said housing mounted in said leading portion of said housing and and disposed above said grid structure at a level sufficient to direct air onto a person's feet positioned on said grid structure, whereby air is directed concurrently onto the bottoms and front portions of feet positioned on said grid structure.

14. An assembly as in claim 1 wherein said air driving means comprises a blower assembly structured to create said forced flow of air and positioned such that said forced flow of air passes at least partially into said air chamber.

15. An assembly as in claim 14 wherein said heating assembly comprises a resistance heating element disposed in the path of said forced flow of air and interrupted relation to said forced flow of air between said blower assembly and said air chamber.

16. An assembly as in claim 1 wherein said air driving means, said heating means and said control means are collectively interconnected and formed in a portable package, said package structured to be removably mounted on said housing so as to selectively deliver heated air thereto.

* * * * *